US006254700B1

(12) United States Patent
Hermanek

(10) Patent No.: US 6,254,700 B1
(45) Date of Patent: Jul. 3, 2001

(54) ABRADABLE QUASICRYSTALLINE COATING

(75) Inventor: Frank J. Hermanek, Indianapolis, IN (US)

(73) Assignee: Praxair S.T. Technology, Inc., Danbury, CT (US)

( * ) Notice: Subject to any disclaimer, the term of this patent is extended or adjusted under 35 U.S.C. 154(b) by 0 days.

(21) Appl. No.: 09/270,134

(22) Filed: Mar. 16, 1999

(51) Int. Cl.[7] ..... B32B 15/20; C22C 21/12

(52) U.S. Cl. ..... 148/403; 428/548; 428/551; 428/650

(58) Field of Search ..... 428/548, 551, 428/650; 148/403

(56) References Cited

U.S. PATENT DOCUMENTS 5,204,191 4/1993 Dubois et al. ..... 428/650
5,432,011 * 7/1995 DuBois et al. .
5,433,978 7/1995 Shield et al. ..... 427/456
5,571,344 * 11/1996 DuBois et al. .
5,652,877 * 7/1997 DuBois et al. .
5,851,317 12/1998 Biner et al. ..... 148/403

OTHER PUBLICATIONS

Peterson, "A Quasicrystal Construction Kit", Science News, vol. 155 (1999) pp 60–61 (No month).

Sordelet "Synthesis, Characterization and Physical Properties of Al–Cu–Fe Quasicrystalline Plasma Sprayed Coatings", Dissertation, Iowa State University (1995) (No Month).

* cited by examiner

*Primary Examiner*—Deborah Jones
*Assistant Examiner*—Jason Savage
(74) *Attorney, Agent, or Firm*—Blake T. Biederman

(57) ABSTRACT

A thermally sprayed coating formed with a quasicrystal-containing alloy, the alloy consisting essentially of, by weight percent, 10 to 45 Cu, about 7 to 22 Fe, 0 to 30 Cr, 0 to 30 Co, 0 to 20 Ni, 0 to 10 Mo, 0 to 7.5 W and balance aluminum with incidental impurities. The alloy contains less than 30 weight percent ψ phase and at least 65 weight percent δ phase. The coating has a macrohardness of less than HR15Y 90.

12 Claims, No Drawings

ABRADABLE QUASICRYSTALLINE COATING

BACKGROUND OF THE INVENTION

1. Field of the Invention

The present invention relates to aluminum-copper-iron quasicrystal alloys and in particular abradable quasicrystal coatings that exhibit low-friction properties.

2. Description of the Related Art

Quasicrystals are materials whose structure cannot be understood within classic crystallographic methodology. These quasiperiodic structures have a long-range orientation order, but lack transitional periodicity. Conventional crystals consist of repeated copies of a single geometric atomic arrangement—a unit-cell stacked upon each other like bricks. Quasicrystals, on the other hand, while also being built up from a single type of atomic clusters, differ in that adjacent clusters overlap, sharing atoms with their neighbors. When clusters overlap by sharing atoms (quasiperiodic packing), they produce denser atomic arrays than conventional, periodic, repeated packing patterns.

The non-periodic structure of Quasicrystals yields a broad, previously unobtainable range of physical properties embodied within a single material. Quasicrystals exhibit poor thermal conductivity while remaining stable up to about 1100° C. Thus, a thin layer on a heat-conducting surface will distribute heat evenly eliminating "hot spots". These hard coatings promote wear and scratch resistance. Furthermore, due to their low coefficient of friction and electronic structure (low surface energy), they possess non-adhesive properties. Finally, they offer resistance to both corrosion and oxidation.

Researchers have identified over eight hundred different quasicrystal alloys. Many of these alloys contain a combination of aluminum, copper and iron. The Al—Cu—Fe alloys yield the specific icosahedral quasicrystal identified in atomic percent as $Al_{65}Cu_{20}Fe_{15}$. (Note: This specification expresses all composition in weight percent, unless specifically noted otherwise). Furthermore, in some instances these alloys contain additional alloying elements such as, chromium, cobalt and nickel. This enables the alloy to accommodate specific operating conditions. For example, DuBois et al., in U.S. Pat. No. 5,204,191, describe several Al—Cu—Fe alloys containing quasi-crystalline phases.

Regardless of chemistry however, quasicrystals do not lend themselves to conventional fabrication. They can not be formed or readily cast; however, they can be reduced to powder and thermally sprayed to form an adherent, useful coating. As far as known however, none of these alloys have established widespread commercial usage.

It is an object of this invention to produce an Al—Cu—Fe quasicrystal alloy coating having decreased hardness for improved abradability.

It is a further object of this invention to produce an abradable Al—Cu—Fe quasicrystal alloy coating having high temperature stability and oxidation resistance.

SUMMARY OF THE INVENTION

A thermally sprayed coating formed with a quasicrystal-containing alloy, the alloy consisting essentially of, by weight percent, 10 to 45 Cu, 7 to 22 Fe, 0 to 30 Cr, 0 to 30 Co, 0 to 20 Ni, about 0 to 10 Mo, 0 to 7.5 W and balance aluminum with incidental impurities. The alloy contains less than 30 weight percent ψ phase and at least 65 weight percent δ phase. The coating has a macrohardness of less than HR15Y 90.

DESRIPTION OF PREFERRED EMBODIMENT

The coating consists of a wear resistant Al—Cu—Fe alloy having less than about 30 weight percent ψ phase and at least about 65 weight percent δ phase thermally sprayed at a subsonic rate sufficient to avoid excessive quantities of the hard ψ phase. Advantageously, the alloy contains at least about 70 weight percent δ phase. Most advantageously, this alloy contains less than about 10 weight percent ψ phase and at least about 80 weight percent δ phase. The thermally sprayed coating possesses excellent abradability and bond strength. Advantageously, the coating has a bond strength of at least about 7 MPa (1 ksi). Furthermore, this quasicrystalline alloy contains chromium or cobalt for corrosion resistance.

Aluminum, copper, iron and chromium were vacuum melted and inert gas atomized. The powder analyzed, by weight percent, 17.5 Cu, 13.3 Fe, 15.3 Cr and balance aluminum. This powder was fully spherical and free flowing. Table 1 lists typical properties of the inert gas atomized AlCuFeCr quasicrystal powder after sizing.

TABLE 1

| | | |
|---|---|---|
| Size | +75 μm | 0.02% |
| | +63 μm | 5.40% |
| | −63 μm | 94.58% |
| Apparent Density | 2.14 g/cm$^3$ | |
| Flow Rate (ASTM B213) | 30 Seconds | |

Due to the alloy's aperiodic lattice structure, x-ray diffraction (XRD) identified the quasicrystals. The positions of the quasicrystal or (icosahedral (ψ)) phase are roughly at 23, 25, 41, 44, 62.5, and 75—an icosahedral is a polygon having 20 faces and a decagon is a polygon having 10 angles and 10 faces. As-atomized, sized powder showed only a minor amount of ψ phase. Rather, a decagonal phase (δ) predominated. The presence of two (2) phases was attributed to the rate of cooling experienced in going from liquid to solid. Cooling rate, and subsequent powder particle solidification, greatly affected resulting phase equilibria. At very fast rates the metastable ψ is formed; if solidification is slowed the δ-phase or its approximates form. Differential thermal analysis (DTA) performed on the powder indicated a melting temperature of about 1044° C.

When reduced to powder, these quasicrystals facilitate thermal spraying with various types of equipment. This includes plasma, HVOF, detonation and other types of thermal spraying equipment. However, for this example plasma was selected as the sole means of application. The equipment used to apply the coatings was the Praxair SG-100 plasma gun. The gun was mounted onto an ABB IRB 2400 robot's arm to facilitate automatic spraying and to ensure consistency. The plasma generator was configured to operate in the sub-sonic mode. Utilized hardware is recorded in Table 2.

TABLE 2

| | |
|---|---|
| Anode | 2083-155 |
| Cathode | 1083A-112 |
| Gas Injector | 3083-113 |
| External Powder Feed | Negative |

The subsonic coatings were applied to and evaluated for macrohardness (HR15Y); microstructure, including density and oxide content as determined using image analysis; surface roughness; XRD for phase distribution; and tensile/ bond testing. Based upon macrohardness and bond strength an optimized set of spray parameters was derived. Along with gun traverse rate, the six active and controllable parameters were given high and low ranges. Table 3 illustrates the controlled parameters.

TABLE 3

| | | | |
|---|---|---|---|
| Amps A | 600 | 650 | 700 |
| 2ndary B | 15 l/min | 20 l/min | 25 l/min |
| Primary C | 32.8 l/min | 37.7 l/min | 42.8 l/min |
| Feed Rate D | 30 g/min | 45 g/min | 60 g/min |
| Distance E | 64 mm | 76 mm | 89 mm |
| Traverse F | 250 cm/min | 305 cm/min | 355 cm/min |

Coatings from the subsonic coating yielded a HR15Y distribution ranging from 81.6 to 85.8. Constructing a Response Table, parameters were calculated for two (2) coatings—one for each end of the hardness spectrum. Predicted hardnesses were 81.5 (low) and 86.5 (high). Both parameter sets were sprayed; results are found in Table 4.

TABLE 4

| | Soft | Softer |
|---|---|---|
| Amperage | 650 | 600 |
| Secondary ($H_2$) | 3.5 l/min | 2.35 l/min |
| Primary (Ar) | 48.37 l/min | 56.6 l/min |
| Feed Rate | 30 g/min | 60 g/min |
| Carrier Gas (Ar) | 4.1 l/min | 4.1 l/min |
| Spray Distance | 76 mm | 64 mm |
| Traverse Rate | 305 cm/min | 250 cm/min |

Table 5 below illustrates the excellent abradable properties achieved with the subsonic thermal spraying of the quasicrystalline alloy.

TABLE 5

| | Soft | Softer |
|---|---|---|
| HR15Y | 86.5 | 83.6 |
| Density | 95.0% | 84.0% |
| Bond Strength | 18.89 MPa | 12.63 MPa |
| Deposit Efficiency | 35% | 25% |

Based upon the porous nature of these subsonic coatings there were no attempts to perform microhardness testing. XRD scans on the two subsonic coatings appear similar, almost a "look alike" of the starting powder. Both coatings are predominately δ with a weak ψ peak at 42. The metallography of the coating illustrated the presence of trans-splat cracking.

Table 6 below provides "about" the thermally sprayed coating's composition, in weight percent.

TABLE 6

| Element | Broad | Intermediate | Narrow |
|---|---|---|---|
| Al | Balance* | Balance* | Balance* |
| Cu | 10–45 | 12–24 | 15–20 |
| Fe | 7–22 | 10–20 | 10–16 |
| Cr | 0–30 | 5–25** | 10–20 |
| Co | 0–30 | 0–20** | 0–15 |
| Ni | 0–20 | 0–15 | 0–10 |

TABLE 6-continued

| Element | Broad | Intermediate | Narrow |
|---|---|---|---|
| Mo | 0–10 | 0–7.5 | 0–5 |
| W | 0–7.5 | 0–6 | 0–5 |

*Plus incidental impurities.
**Cr + Co is at least 10.0

The hardness and bond strength properties initially targeted for modification were appreciably improved. For example, hardness improved from HR15N levels for conventional thermal spraying to a level of less than about HR15Y 90. Advantageously, the alloy has a hardness of less than about HR15Y 85. Most advantageously, the alloy has a hardness of about HR15Y 65 to 85. Quasicrystals have very poor thermal conductivity and therefore any level of inputted thermal energy should be considered when spraying.

These "soft" quasicrystal coatings provide excellent abradable thermal barrier underlayments. Furthermore, it is possible to improve abradability and lubricity with additions of polymers (such as, nylon, polyamides and polyesters), boron nitride, clad boron nitride (nickel or chromium) and nickel-coated graphite.

The coating retains at least 65 weight percent δ phase and limits ψ phase to less than 30 weight percent to ensure a soft abradable alloy. This coating may be sprayed onto either metallic or non-metallic substrates. Finally, the quasicrystalline alloy readily incorporates chromium and cobalt additions for improved high temperature oxidation resistance.

Although the invention has been described in detail with reference to a certain preferred embodiment, those skilled in the art will recognize that there are other embodiments of the invention within the spirit and the scope of the claims.

What is claimed is:

1. A thermally sprayed coating composition formed with a quasicrystal-containing alloy, the alloy consisting essentially of, by weight percent, about 10 to 45 Cu, about 7 to 22 Fe, about 0 to 30 Cr, about 0 to 30 Co, about 0 to 20 Ni, about 0 to 10 Mo, about 0 to 7.5 W and balance aluminum with incidental impurities and having less than about 30 weight percent ψ phase and at least about 65 weight percent δ phase and the coating having a macrohardness of less than about HR15Y 90.

2. The coating of claim 1 wherein the coating has a macrohardness of less than about HR15Y 85.

3. The coating of claim 1 wherein the alloy contains at least about 70 weight percent δ phases.

4. The coating of claim 1 wherein the coating contains soft particles selected from the group consisting of polymers, boron nitride, clad boron nitride, and nickel-coated graphite.

5. A thermally sprayed coating composition formed with a quasicrystal-containing alloy, the alloy consisting essentially of, by weight percent, about 12 to 24 Cu, about 10 to 20 Fe, about 5 to 25 Cr, about 0 to 20 Co, at least about 10 total Cr and Co, about 0 to 15 Ni, about 0 to 7.5 Mo, about 0 to 6 W and balance aluminum with incidental impurities and having less than about 30 weight percent ψ phase and at least about 65 weight percent δ phase and the coating having a macrohardness of less than about HR15Y 90.

6. The coating of claim 5 wherein the coating has a macrohardness of less than about HR15Y 85.

7. The coating of claim 5 wherein the alloy contains at least about 70 weight percent δ phase.

8. The coating of claim 5 wherein the coating contains soft particles selected from the group consisting of polymers, boron nitride, clad boron nitride and nickel-coated graphite.

9. A thermally sprayed coating composition formed with a quasicrystal-containing alloy, the alloy consisting essentially of, by weight percent, about 15 to 20 Cu, about 10 to 16 Fe, about 10 to 20 Cr, about 0 to 10 Co, about 0 to 10 Ni, about 0 to 5 Mo, about 0 to 5 W and balance aluminum with incidental impurities and having less than about 30 weight percent ψ phase and at least about 65 weight percent δ phase and the coating having a macrohardness of less than about HR15Y 90.

10. The coating of claim 9 wherein the coating has a macrohardness of about HR15Y 65 to 85.

11. The coating of claim 9 wherein the alloy contains less than 10 weight percent ψ phase and at least about 80 weight percent δ phase.

12. The coating of claim 9 wherein the coating contains soft particles selected from the group consisting of polymers, boron nitride, clad boron nitride and nickel-coated graphite.

* * * * *